US009214082B2

(12) United States Patent
Koenig et al.

(10) Patent No.: US 9,214,082 B2
(45) Date of Patent: Dec. 15, 2015

(54) SYSTEM AND METHOD FOR ALARM SYSTEM TAMPER DETECTION AND REPORTING

(75) Inventors: Darren A. Koenig, Bronxville, NY (US); Michael Gregory, Carrollton, TX (US); Jeffrey O. Smith, Dallas, TX (US)

(73) Assignee: Numerex Corp., Atlanta, GA (US)

( * ) Notice: Subject to any disclaimer, the term of this patent is extended or adjusted under 35 U.S.C. 154(b) by 97 days.

(21) Appl. No.: 13/484,973

(22) Filed: May 31, 2012

(65) Prior Publication Data

US 2013/0321150 A1 Dec. 5, 2013

(51) Int. Cl.

| | |
|---|---|
| ***G08B 13/00*** | (2006.01) |
| ***G08B 25/08*** | (2006.01) |
| ***G08B 25/00*** | (2006.01) |
| ***G08B 25/14*** | (2006.01) |
| ***G08B 29/04*** | (2006.01) |

(52) U.S. Cl.

CPC ..... *G08B 25/08* (2013.01); *G08B 25/008* (2013.01); *G08B 25/009* (2013.01); *G08B 25/14* (2013.01); *G08B 29/046* (2013.01)

(58) Field of Classification Search

CPC .... G08B 29/046; G08B 13/08; G08B 25/008; G08B 25/001; G08B 29/181

USPC ..... 379/37, 39, 42; 701/217

See application file for complete search history.

(56) References Cited

U.S. PATENT DOCUMENTS

| | | | | |
|---|---|---|---|---|
| 5,594,428 | A * | 1/1997 | Peterson | 340/12.22 |
| 6,114,955 | A * | 9/2000 | Brunius et al. | 340/539.24 |
| 7,248,157 | B2 * | 7/2007 | Bergman et al. | 340/531 |
| 7,619,512 | B2 * | 11/2009 | Trundle et al. | 340/506 |
| 8,368,532 | B2 * | 2/2013 | Foisy et al. | 340/540 |
| 8,707,059 | B2 * | 4/2014 | Christianson et al. | 713/194 |
| 2004/0024851 | A1 | 2/2004 | Naidoo et al. | |
| 2004/0150521 | A1 | 8/2004 | Stilp | |
| 2005/0216302 | A1 | 9/2005 | Raji et al. | |
| 2006/0034255 | A1 * | 2/2006 | Benning et al. | 370/352 |
| 2006/0168190 | A1 | 7/2006 | Johan et al. | |
| 2007/0210909 | A1 * | 9/2007 | Addy | 340/506 |
| 2009/0135010 | A1 * | 5/2009 | Fosty et al. | 340/541 |

* cited by examiner

*Primary Examiner* — Travis Hunnings
*Assistant Examiner* — Edny Labbees
(74) *Attorney, Agent, or Firm* — Bell Nunnally & Martin LLP; Craig J. Cox

(57) ABSTRACT

An alarm system for detecting and reporting "smash and crash" intrusions is described. The alarm system includes a plurality of intrusion sensors and a security alarm panel in communication with each of the plurality of intrusion sensors at the site of the alarm system. An alarm gateway is provided remote from the security alarm panel, the alarm gateway monitoring the status of the security alarm panel for indications of tampering. A central station is in communication with the alarm gateway and monitors the status of the alarm system, where the alarm gateway sends an alarm condition to the central station when tampering at the security alarm panel is detected.

11 Claims, 4 Drawing Sheets

SYSTEM AND METHOD FOR ALARM SYSTEM TAMPER DETECTION AND REPORTING

CROSS REFERENCE TO RELATED INFORMATION

This application claims the benefit of U.S. Provisional Patent Application Ser. No. 61/491,604, filed May 31, 2011.

TECHNICAL FIELD

The present disclosure is directed to alarm systems and more particularly to a system and method to detect and report tampering with security alarms.

BACKGROUND OF THE INVENTION

Existing security alarm systems, including premise alarm systems and vehicle alarms, consist primarily of a panel or controller that houses an electronic controller (typically referred to as the "panel" in premise alarm systems), and sensors distributed throughout the monitored premise or vehicle but connected back to the security system controller, or panel, for the purpose of detecting an intrusion event, or other reportable event, whereupon the security system controller reports the event to a centralized alarm monitoring system or gateway to centralized alarm monitoring system via wired or wireless communications channels.

Using a premise alarm system as an example only, one method of defeating such typical security alarm systems is for an intruder to quickly enter the premises and destroy the premise's security system controller panel before the intrusion event can be reported. This is commonly referred to in the trade as "crash and smash". This is possible because typical alarm panels delay reporting an entry event for a period of time to permit an authorized person to cancel the intrusion event by entering an authorized code into a keypad associated with the panel. U.S. Pat. No. 7,619,512 (the '512 patent) illustrates an existing method to attempt to address the crash and smash issue. Rather than delaying the sending of an intrusion event, the system described by the '512 patent immediately sends the intrusion event signal and if the user enters a valid cancellation code into a keypad within an allotted time then the alarm event is canceled at the remote alarm receiver. In other words, an immediate intrusion signal is sent and if it isn't followed by a deactivation within a set time, then the alarm panel is assumed to have been attacked. One problem with the system described by the '512 patent is that the security premise alarm system panel tampering is an assumption, leaving open the opportunity for false alarms, which can be costly and wasteful for both the user and the civil authorities.

The concepts described herein improve upon prior art by providing explicit detection and reporting of a crash and smash tampering attempt upon a security premise alarm system panel, thereby mitigating the possibility of false alarms.

BRIEF SUMMARY OF THE INVENTION

In an embodiment of an alarm system according to the present invention, an alarm system is described that includes a plurality of intrusion sensors and a security alarm panel in communication with each of the plurality of intrusion sensors and also in communication with a central station, the central station monitoring the status of the alarm system. A tamper sensor monitors the condition of the security alarm panel and is operable to send a tamper alert to the central station if tampering is detected at the security alarm panel.

In another embodiment, a method of detecting and reporting tampering with an alarm system is described. The method includes detecting an intrusion signal from one of a plurality of intrusion sensors, the intrusion signal sent to an alarm gateway by a security alarm panel monitoring the intrusion sensors. The method further includes monitoring the security alarm panel for indications of tampering, and sending an alarm condition to a central monitoring station upon detection of tampering at the security alarm panel.

In yet another embodiment an alarm system is described that includes a plurality of intrusion sensors and a security alarm panel in communication with each of the plurality of intrusion sensors. An alarm gateway is in communication with the security alarm panel, and monitors the status of the security alarm panel for indications of tampering. A central station is in communication with the alarm gateway and monitors the status of the alarm system, where the alarm gateway sends an alarm condition to the central station when tampering at the security alarm panel is detected.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Preferred embodiments of a system according to the concepts described herein enables explicit detection of security alarm panel tampering by incorporating combinations of event communications, tamper sensors and a query and response communications method that uniquely mitigates the possibility of a false alarm crash and smash tamper notification. While such concepts are described using a premise alarms an example only, the concepts can be applied to any type of alarm system including vehicle and other similar alarm systems.

Figure 1:
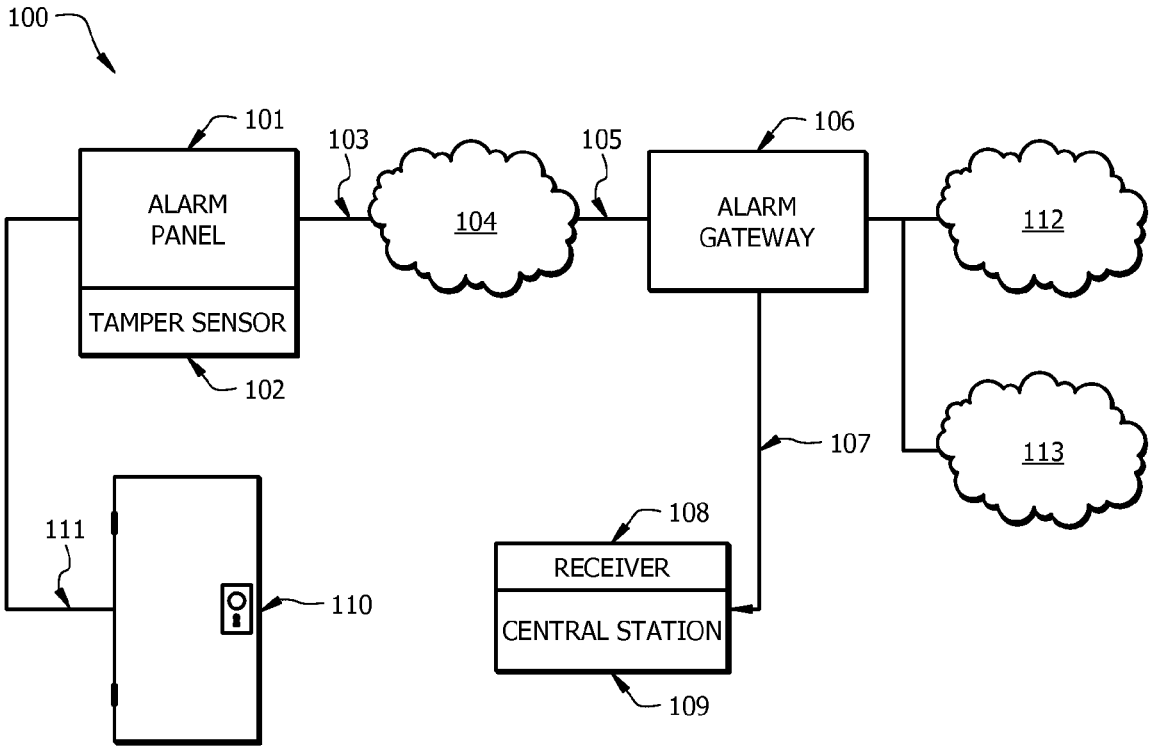
FIG. 1 is a system diagram of an embodiment of a system detecting and reporting tampering with an alarm system.

Referring now to FIG. 1, FIG. 1 illustrates an embodiment of a system 100 for detecting and reporting tampering with an alarm system according to the concepts described herein. Security alarm panel 101, which is shown as a premises alarm, but could be any type of alarm system having a control panel interface, communicates with tamper sensor 102 that can detect one or more factors, such factors including contact position, physical motion, shock, noise, loss of external electric power, or other suitable environmental factor, which separately, or in combination are indicative of a tampering with the alarm panel or controller. Alarm sensor 110 illustrates one of potentially numerous points, such as doors, windows, spaces, etc. monitored for intrusion with sensors, such as contact sensors, magnetic reed switch, noise detectors, motion sensors or other similar intrusion detection sensor, connected to security alarm panel 101 by local wireless or wired circuits 111. If sensor 110 is tripped, security alarm panel 101 can be programmed to immediately transmit an intrusion event signal to alarm gateway 106 via communications path 103, which could be, but is not limited to a wireless or wired network or broadband link, Short Message Service (SMS), or cellular link for example, to typically through a commercial communication provider 104, such as AT&T, Verizon, etc., then via network channel 105, which could, in a preferred embodiment, be the Internet. Alarm gateway 106 contains data servers and communications connectivity. In preferred embodiments, alarm gateway 106 makes a record of the immediate intrusion alarm signal but does not forward it until other criteria, such as those described below, are met. If the tamper sensor, or sensors, 102 incorporated within security alarm panel 101 detect tampering or loss of commercial power, a tamper alarm event is communicated to Alarm Gateway 106 using the paths as described above, or other equivalent mechanisms for reporting the alarm condition.

In preferred embodiments of system 100, if alarm gateway 106 has first received an intrusion alarm signal and subsequently received a tamper alarm event signal, the situation may be considered to be a "crash and smash" and then the security alarm panel 101 forwards an alarm event denoting that case to the receiver 108 located at central station 109 via communications channel 107. A typical reaction of operators at central station 109 would be to dispatch civil authorities to investigate the monitored premises and/or also send other types of notifications, including, but not limited to text messages, such as SMS messages, email messages, voice messages, either live or recorded, via commercial communications services 112 or private communications network 113.

Figure 2:
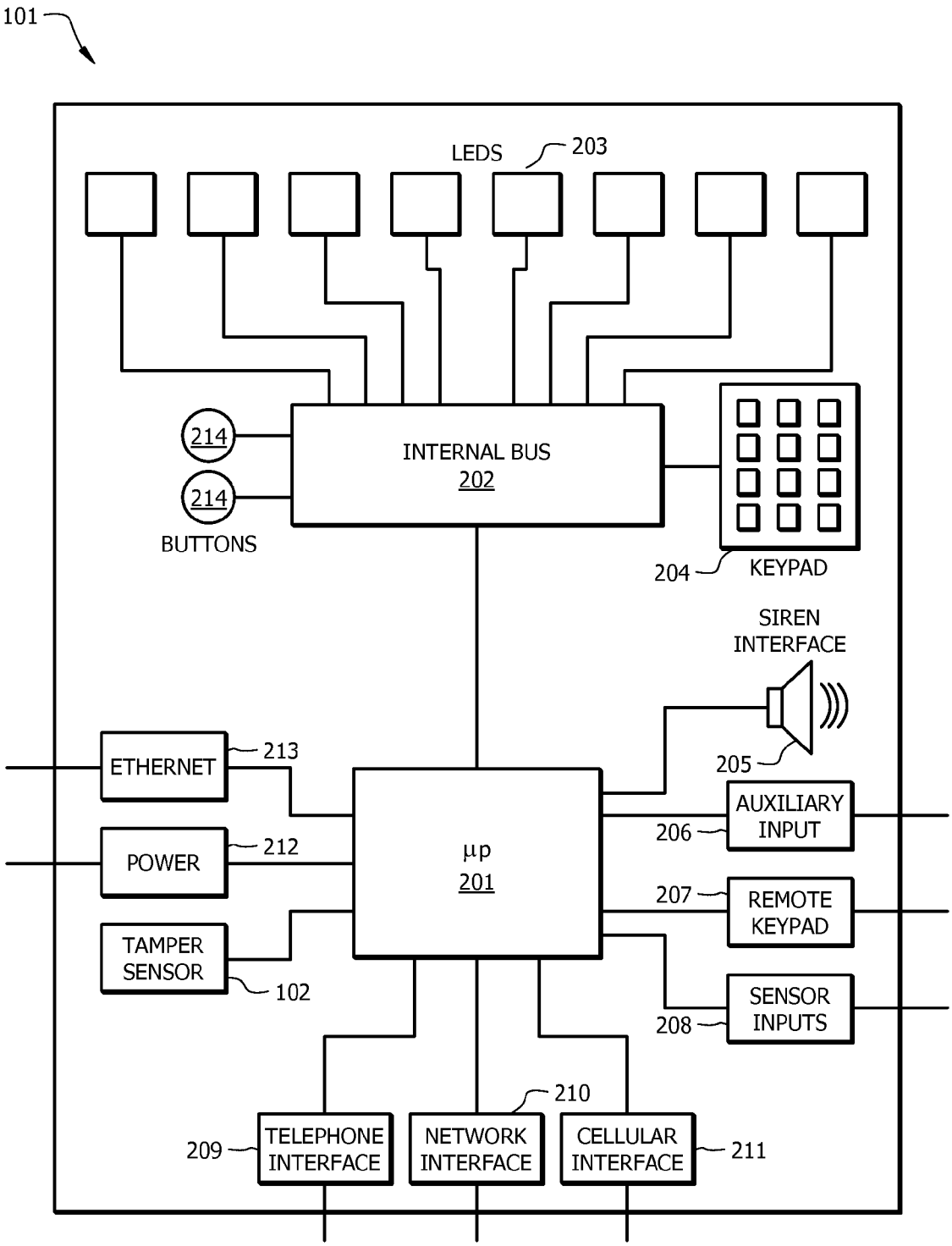
FIG. 2 is a block diagram of an embodiment of an alarm panel in accordance with the concepts described herein.

Referring now to FIG. 2, an embodiment of a security alarm panel 101 in accordance with the concepts described herein is shown. Security alarm panel 101 includes a microprocessor 201 operable to control the operation and communications of security alarm panel 101. As described with FIG. 1, tamper sensor, or sensors, 102 are operable to detect manipulation of or tampering with security alarm panel 101. As described, any type or combination of sensors that can detect inappropriate motion, physical harm, damage, loss of power, or other tampering condition can be used in accordance with the concepts described herein.

Sensor inputs 208 receive inputs from all of the remote alarm sensors monitored by security alarm panel 101, such as door sensor 110 from FIG. 1. LEDs 203 show the status of security alarm panel 101 and provide information to the user regarding alarm conditions and security zones. Buttons 214 and keypad 204 allow for user interaction with security alarm panel 101, such as allowing arming and disarming of the system and allowing programming of various user controllable aspects of the alarm system. Some of the various interfaces to security alarm panel 101, such as LEDs 203, keypad 204, buttons 214, etc., may be connected to microprocessor 201 through an internal bus 202.

Microprocessor 201 is also operable to control other aspects of the security system, such as siren interface 205 which, when present, activates and deactivates an audible siren, and remote keypad 207 which allow the installation of other keypads to control the alarm systems from other areas of the premises, such as a back door. Auxiliary input 206 can be a port that allows other devices, sensors, controllers, diagnostic equipment, etc., to be connected to security alarm panel 101. Power module 212 provides the connection to an external power source for security alarm panel 101. A backup power source, such as a battery, can also be included. Ethernet port 213 allows security alarm panel 101 to be connected to a local area network for control, diagnostic and programming purposes.

Security alarm panel 101 also preferably includes one or more communication interfaces such as communications path 103 from FIG. 1. Communications interfaces can include land line telephone interface 209 which communicates with traditional wired telephone lines, network, interface 210, which can be connected with wired or wireless networks, and cellular interface 211 which provides communications with typical cellular telephone networks Other interfaces, such as radio frequency, satellite, etc., can be used in addition to or in place of the other communications interfaces.

Figure 3:
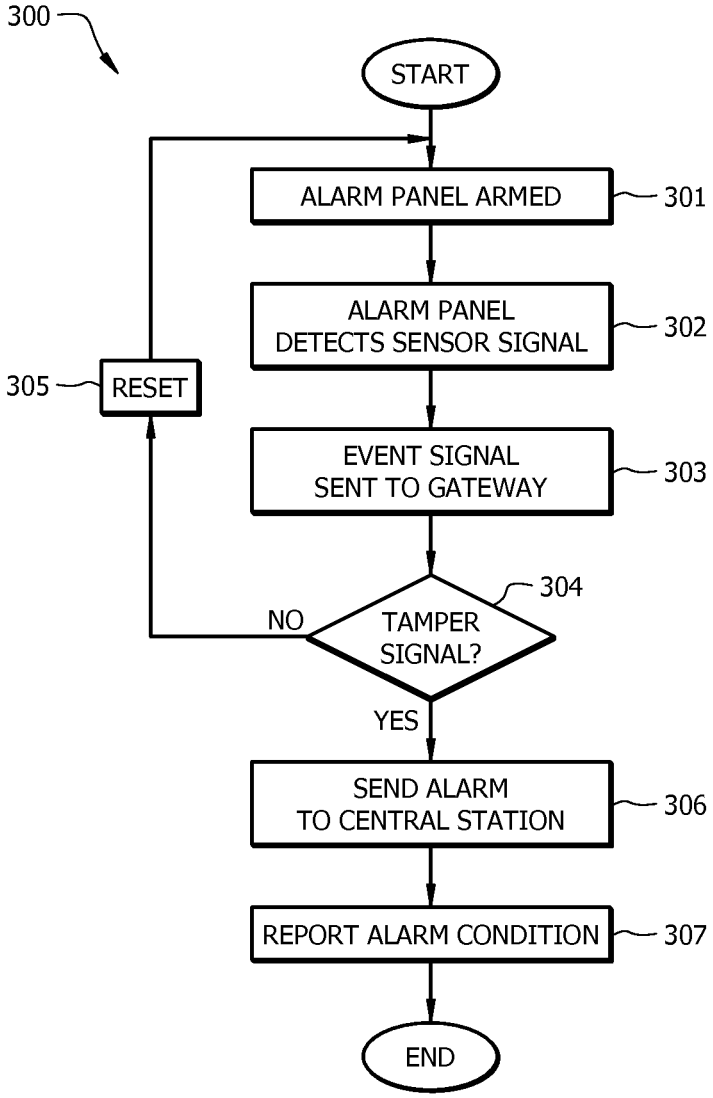
FIG. 3 is a flow chart of an embodiment of a method for detecting and reporting tampering with an alarm system.
Figure 4:
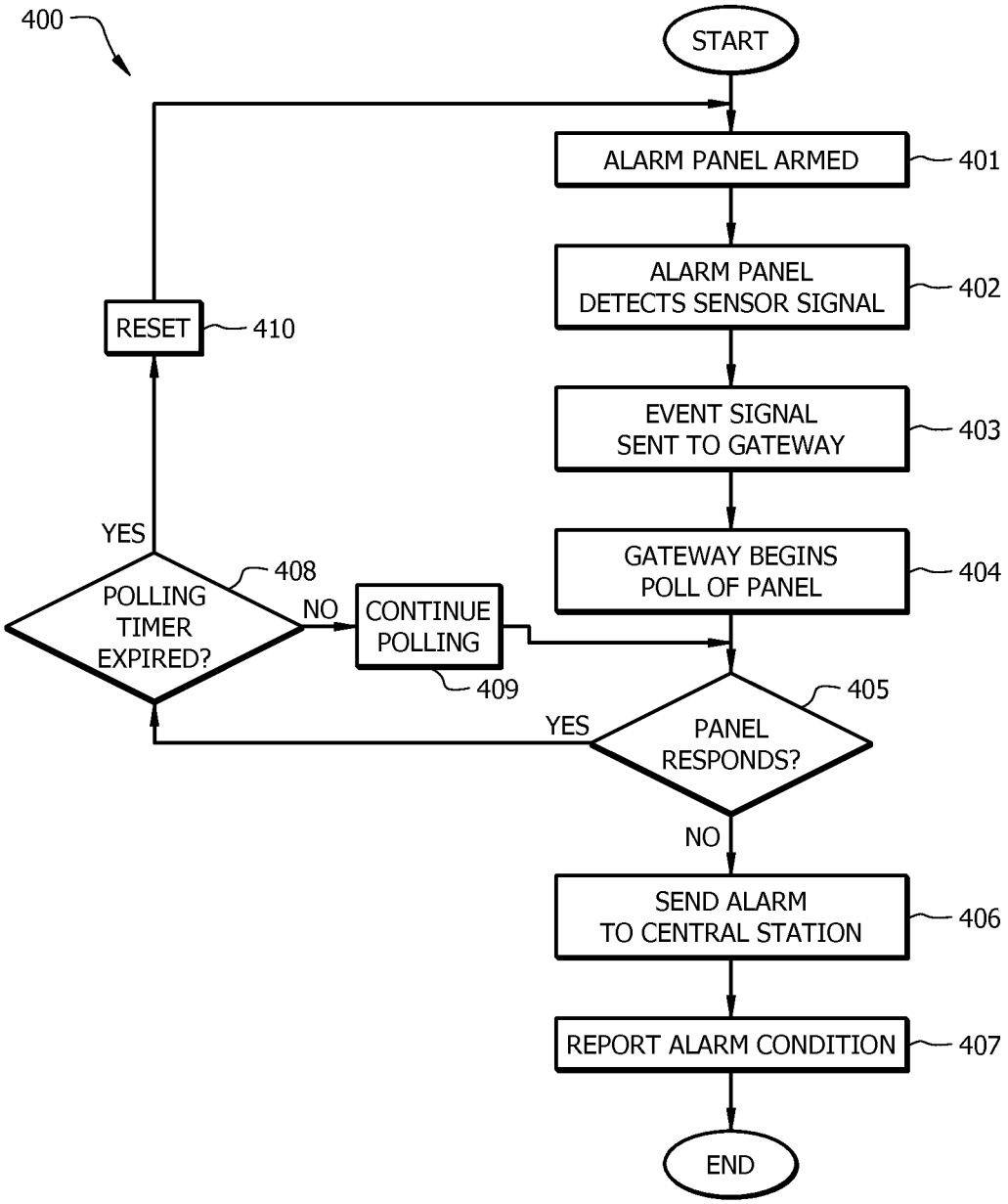
FIG. 4 is a flow chart of an alternate embodiment of a method for detecting and reporting tampering with an alarm system.

Referring now to FIG. 3, with continuing reference to FIG. 1, an embodiment of process for detecting and reporting tampering with an alarm system is described. Method 300 begins with security alarm panel 101 being armed as shown in block 301. When security alarm panel 101 detects a sensor signal as shown by block 302, such as a signal from contact sensor 110, an event signal is sent to alarm gateway 106, as represented by block 303. In block 304, tamper sensor 102 is used to detect a tamper condition with security alarm panel 101. If a tamper signal is not detected, the system is reset in block 305 and the process restarts. If a tamper signal is detected by tamper sensor 102 and transmitted to alarm gateway 106, the alarm signal is sent to central station 109 as shown by block 306, as described with respect to FIG. 1. The alarm condition can then be reported to authorities or the owners of the alarm as represented by block 307.

Referring now to FIG. 3, another embodiment of a process for detecting and reporting tampering with an alarm system is described. In method 400, after security alarm panel 101 has been armed, as shown by block 401, if alarm gateway 106 has first received an intrusion alarm signal, block 402, from security alarm panel 101, as shown by block 403, via the communications paths previously discussed, alarm gateway 106 initiates a query response polling sequence wherein alarm gateway 106 queries security alarm panel 101 at regular, predetermined intervals, for example every ten seconds, as shown in block 404. In block 405, alarm gateway 106 determines if a response to the polling has been received from security alarm panel 101. If a response is received to the query, alarm gateway can reset or determine if it should continue polling, as shown by block 408. If the polling timer has expired, the system resets, as shown by block 408, otherwise method 400 continues polling, as shown by block 409. If central station 109 receives a valid disarm signal during the polling process, the polling sequence is terminated and the system's status is reset to a no-alarm state.

If a response from security alarm panel 101 is not promptly received by alarm gateway 106 within a predetermined time for example 5 seconds, then security alarm panel 101 is deemed to have been tampered with and central station 109 will be alerted in the same manner as previously described as shown by block 406. The alarm condition can then be reported to authorities or the owners of the alarm as represented by block 407.

The system and method described herein can also incorporate multiple conditions for a contact signal to be sent to a central station by a remote server or controller. In an embodiment, the system is armed and a signal is sent to an intermediate server. An intrusion zone, for example a door sensor, window sensor, motion detector or the like, is triggered and a signal is sent to an intermediate server. The remote server begins monitoring the network (GSM, broadband, VoIP, . . . ) registration of the device, and if the device registration is lost before a disarm signal is received, or if there is a signal indicating loss of AC power received before disarm signal then the tamper alert is issued to the central server indicating a "smash and crash" event.

In another embodiment, a contact ID signal is sent to a central station by a remote server when the system is armed and a signal is sent to our intermediate server and there is an intrusion zone triggered. A signal is sent to our intermediate server, and the remote server begins polling the device on a regular frequency (every 5, 10, 20, 30 seconds . . . ). If the device response to the polling is late by a selected time period (such as for example, 20 seconds) and the disarm signal has not been received, the tamper alert is sent to the central server. Another embodiment could also be network specific like a GPRS session between the intermediate server and the device was ended or interrupted based on a device side condition.

In yet another embodiment, a contact ID signal is sent to a central station by our remote server where the system is armed and a signal is sent to our intermediate server and an intrusion zone is triggered and a signal is sent to the intermediate server. The device sends a status signal over the network to the intermediate server on a regular basis, (for example, 5, 10, 20, 30 seconds . . . ). The server monitors the timing of the signals and if the status signal is late by a selected time period (i.e. 20 seconds) and the disarm signal has not been received then the tamper alert signal is sent to the central station.

Other embodiments can include any physical tamper sensors or signals, physical motion/shock sensors or signals, loss of AC power sensors or signals.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An alarm system comprising:

a plurality of intrusion sensors;

a security alarm panel in communication with each of the plurality of intrusion sensors and also in communication with a central station, the central station monitoring the status of the alarm system;

a tamper sensor monitoring the condition of the security alarm panel in response to an intrusion signal from an intrusion sensor, and operable to send a tamper alert to the central station if tampering is detected at the security alarm panel, wherein the tamper sensor includes sensors to detect one or more of the following: contact position, physical motion, shock, noise, and loss of external electric power; and an alarm gateway remote from the security alarm panel and comprising a single communication path between the security alarm panel and the central station and operable, in response to detecting an intrusion signal, to monitor the security alarm panel for the tamper alert when one or more of the intrusion sensors are triggered and further operable to report the tamper alert to the central station as an alarm condition.

2. The alarm system of claim 1 wherein the security alarm panel communicates with the alarm gateway over a cellular network.

3. The alarm system of claim 1 wherein the security alarm panel communicates with the alarm gateway over a land line telephone network.

4. The alarm system of claim 1 wherein the security alarm panel communicates with the alarm gateway over a network connection.

5. A method of detecting and reporting tampering with an alarm system, the method comprising:

detecting an intrusion signal from one of a plurality of intrusion sensors, the intrusion signal sent to an alarm gateway by a security alarm panel monitoring the intrusion sensors;

in response to detecting the intrusion signal, monitoring the security alarm panel for indications of tampering by detecting a tamper signal from a tamper sensor that detects one or more of the following: contact position, physical motion, shock, noise, and loss of external electric power;

in response to detecting the intrusion signal, beginning a GPRS session between the security alarm panel and the alarm gateway; and sending an alarm condition to a central monitoring station upon detection of tampering at the security alarm panel.

6. The method of claim 5 wherein monitoring the security alarm panel for indications of tampering includes polling the security alarm panel using the alarm gateway, such that the failure of the security alarm panel to respond to the polling indicates tampering at the security alarm panel.

7. The method of claim 5 wherein the security alarm panel communicates with the alarm gateway over a cellular network.

8. The method of claim 5 wherein the security alarm panel communicates with the alarm gateway over a land line telephone network.

9. The method of claim 5 wherein the security alarm panel communicates with the alarm gateway over a network connection.

10. An alarm system comprising:

a plurality of intrusion sensors;

a security alarm panel in communication with each of the plurality of intrusion sensors;

a tamper sensor monitoring the condition of the security alarm panel and operable to send a tamper alert to a central station if tampering is detected at the security alarm panel, wherein the tamper sensor includes sensors to detect one or more of the following: contact position, physical motion, shock, noise, and loss of external electric power;

an alarm gateway in communication with the security alarm panel, the alarm gateway, in response to receiving an intrusion signal, monitoring the status of the security alarm panel for indications of tampering; and a central station in communication with the alarm gateway and monitoring the status of the alarm system, the alarm gateway comprising a single communication path between the security alarm panel and the central station, wherein the alarm gateway sends an alarm condition to the central station when tampering at the security alarm panel is detected; and wherein monitoring the status of the security alarm panel for indications of tampering includes polling the security alarm panel using the alarm gateway, such that the failure of the security alarm panel to respond to the polling indicates tampering at the security alarm panel.

11. The method of claim 10 wherein the security alarm panel communicates with the alarm gateway over at least one of: a cellular network, a telephone network, and a data network.

* * * * *